US007699460B2

(12) United States Patent
Yokoi

(10) Patent No.: US 7,699,460 B2
(45) Date of Patent: Apr. 20, 2010

(54) PRINTING APPARATUS AND PRINTING METHOD

(75) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 538 days.

(21) Appl. No.: 11/199,123

(22) Filed: Aug. 9, 2005

(65) Prior Publication Data

US 2006/0033795 A1 Feb. 16, 2006

(30) Foreign Application Priority Data

Aug. 12, 2004 (JP) ..... 2004-235581

(51) Int. Cl.
*B41J 2/01* (2006.01)

(52) U.S. Cl. ..... 347/104

(58) Field of Classification Search ..... 347/3, 347/5, 36, 37

See application file for complete search history.

(56) References Cited

U.S. PATENT DOCUMENTS

| | | | | |
|---|---|---|---|---|
| 5,997,129 | A | 12/1999 | Matsuhashi | |
| 6,727,932 | B2 * | 4/2004 | Enomoto et al. | 347/188 |
| 2003/0063152 | A1 * | 4/2003 | Edamura et al. | 347/36 |
| 2004/0004645 | A1 * | 1/2004 | Kanda et al. | 347/19 |
| 2004/0017456 | A1 * | 1/2004 | Obertegger et al. | 347/104 |
| 2004/0145617 | A1 * | 7/2004 | Nunokawa | 347/16 |
| 2004/0246285 | A1 * | 12/2004 | Endo | 347/14 |

FOREIGN PATENT DOCUMENTS

| | | | |
|---|---|---|---|
| EP | 1449662 | A1 * | 8/2004 |
| EP | 1449662 | A1 * | 12/2004 |
| JP | 8-169155 | | 7/1996 |
| WO | WO 03070468 | A1 * | 8/2003 |

OTHER PUBLICATIONS

English translation of WO 2003070468 A1 ; Endo, Hironori; JP.*

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

It is an object of the present invention to provide a printing apparatus and a printing method which can perform an appropriate printing operation on a print medium while keeping an ink ejection range to a minimum required even when the print medium transported is deviated from a theoretical position, and which can also reduce a running cost and ink mist. Thus, the present invention is characterized by determining the actual position of the print medium transported to the printing position; based on the determined print medium position, setting an area slightly larger than the print medium lying area as a print area; and performing the printing operation on that area.

7 Claims, 11 Drawing Sheets

PRINTING APPARATUS AND PRINTING METHOD

BACKGROUND OF THE INVENTION

1. Field of the Invention

The present invention relates to a printing apparatus and a printing method for printing an image on an entire print medium by transporting the print medium relative to printing means that prints an image by forming dots on the print medium.

2. Description of the Related Art

Demands for digital image printing apparatus as output devices for a wide range of electronic equipment, including computers, copying machines and facsimiles, are growing significantly. The printing apparatuses currently in use are capable of using various print mediums, such as plain paper, OHPs and glossy paper. Information that can be printed includes various kinds of data, such as graph and pictures as well as general documents. Of the printing apparatus, an ink jet printing apparatus has come to be able to print images of high quality, even surpassing that of silver salt pictures thanks to a higher density integration of printing means and a color image printing capability that have become possible in recent years. Because of these advantages, there are increasing numbers of occasions where the ink jet printing apparatus is used for printing photographs.

With the picture printing application of the ink jet printing apparatus ever increasing, a so-called "marginless printing", which prints an image on the entire surface of a print medium without leaving a margin edge along a periphery of the print medium, has come to be one of the important printing methods in the ink jet printing apparatus as in the case with silver salt pictures.

Among ink jet printing apparatus capable of implementing such a "marginless printing", there is, for example, an apparatus disclosed in Japanese Patent Application Laid-Open No. 8-169155.

In an ink Jet printing apparatus disclosed in Japanese Patent Application Laid-Open No. 8-169155 (1996), a setting of print data for marginless printing is performed as shown in FIG. 10 and FIG. 11.

FIG. 10 shows how print data to be printed in one main scan of a print head is arranged in a main scan buffer, in a so-called serial type ink jet printing apparatus which performs printing by moving ink jet printing means (print head) having a plurality of print elements (or nozzles) in a direction perpendicular to a transport direction of the print medium. FIG. 11 shows how print data is set on the entire area of a print medium for the marginless printing.

When the printing is done in one main scan of the print head, it is necessary to store in a buffer data which indicates whether or not a dot is to be formed at each position arranged in the main scan direction at a pitch that matches a dot formation pitch for each nozzle.

The main scan buffer BF shown in FIG. 10 represents a case where the number of nozzles arrayed in the print head is V and the number of printed dots in the entire area of the print medium in the main scan direction is H.

In the figure, Hb1 and Hb2 indicate the number of dots to be formed in areas overrunning from the left and right side edges of the print medium (front and rear ends in the scan direction) when a marginless printing is performed. When the marginless printing is performed, those areas overrunning the print medium onto which ink is ejected need to be set for the following reasons.

When a print medium is supplied and transported, an actual position of the print medium may deviated from a theoretical position T0 set n the printing apparatus, as shown in FIG. 11. This positional deviation varies according to dimensional errors of components making up the printing apparatus that occur during the manufacturing process and to changes in conditions for supplying and transporting print medium that are caused by temperature and humidity variations. Therefore, these variations are difficult to eliminate completely.

If a marginless printing is performed with the print medium position deviated from a theoretical position and the printing operation (ink ejection operation) is performed only on the theoretical position of the print medium, an area overrunning from the theoretical print medium position fails to be applied with ink, forming a margin W. This indicates that the marginless printing is not performed properly.

Thus, in performing the marginless printing, it is conventional practice to set an overrunning area T2 where the printing operation is performed outside the periphery of the theoretical print medium position set on the printing apparatus, as shown in FIG. 11. As a result, should the print medium, after being supplied and transported, deviate from the theoretical position, this enables the entire print medium to be applied with ink. In FIG. 11, n represents an area printed by nth main scan and n1 an area printed by (n+1)th main scan.

In the ink jet printing apparatus disclosed in Japanese Patent Application Laid-Open No. 8-169115 (1996), however, a maximum value of positional deviation of the print medium is experimentally determined and a uniform overrunning area T2 of a width equal to the maximum deviation is set outside of and along the periphery of the theoretical print medium position. Normally, the width of the overrunning area T2 is set to about 1 mm to 3 mm.

With this arrangement the amount of ink applied to where the print medium does not exist tends to be comparatively large, causing a variety of inconveniences.

One such inconvenience is an increased running cost due to increased ink consumption. The ink consumption for one sheet of print medium is the amount of ink applied to the overrunning area added to the amount of ink applied to the entire surface of the print medium. Therefore, the larger the overrunning area, the higher the running cost based on ink consumption becomes.

Another inconvenience is a contamination of interior of the printing apparatus with ink. The ink jet printing apparatus for marginless printing has an ink absorber installed at the printing position so as to absorb that part of the ink applied to the overrunning area T2 which does not land on the print medium S. However, the print head produces minuscule ink droplets (ink mist) as well as normal-size ink droplets that land on the print medium S and the ink absorber. The ink mist is carried by an air flow produced by the main scan operation of the print head, floats around and eventually adheres to various parts other than the absorber, contaminating the interior of the printing apparatus. As the overrunning area T2 increases, the degree of contamination deteriorates.

SUMMARY OF THE INVENTION

It is an object of the present invention to provide a printing apparatus and a printing method which can perform an appropriate printing operation on a print medium while keeping an ink ejection range to a minimum required even when the print medium transported is deviated from a theoretical position, and which can also reduce a running cost and ink mist.

To achieve the above objective, the present invention provides the following construction.

That is, a first aspect of the present invention provides a printing apparatus for performing a printing operation without leaving a margin along an edge of a print medium by ejecting ink from printing means having a plurality of print elements, onto an area on the print medium and onto an area outwardly overrunning the print The printing apparatus comprises: transport means for transporting the print medium; scanning means for scanning the printing means in a scan direction crossing a transport direction of the print medium; end detection means for detecting a plurality of end positions of the print medium transported by the transport means; calculation means for, based on the plurality of end positions of the print medium detected by the end detection means, calculating a lying position of the print medium in the scan area scanned by the printing means; setting means for, based on the print medium lying position in the scan area calculated by the calculation means, setting print data for a print medium lying area and for an area outwardly overrunning the print medium lying area; and control means for, based on the print data set by the setting means, driving the printing means to execute the printing operation.

A second aspect of the present invention provides a method of performing a printing operation without leaving a margin along an edge of a print medium by ejecting ink from printing means based on print data of a larger size than that of the print medium. The method comprises the steps of: transporting the print medium; detecting a plurality of end positions of the print medium transported by said transport step; based on the end positions detected by the end detection step, generating print data for an area on the print medium and for an area outwardly overrunning the print medium; and based on the print data generated by the print data generation step, performing a printing operation using the printing means without leaving a margin along an edge of the print medium.

A third aspect of the present invention provides a printing apparatus capable of executing a marginless printing that performs a printing operation without leaving a margin along an edge of a print medium by ejecting ink from printing means based on print data of a larger size than that of the print medium. The printing apparatus comprises transport means for transporting the print medium; end detection means for detecting a plurality of end positions of the print medium transported by the transport means generation means for, based on the end positions detected by the end detection means, generating print data for an area on the print medium and for an area outwardly overrunning the print medium; and control means for, based on the print data generated by the generation means, driving the printing means to execute the marginless printing.

A fourth aspect of the present invention provides a printing apparatus capable of executing a marginless printing that performs a printing operation without leaving a margin along an edge of a print medium, the printing apparatus comprising: means for receiving print data of a larger size than that of the print medium; transport means for transporting the print medium; end detection means for detecting a plurality of end positions of the print medium transported by said transport means; determination means for, based on the end positions detected by the end detection means, determining print data for an area on the print medium and for an area outwardly overrunning the print medium; and control means for, based on the print data determined by the determination means, driving the printing means to execute the marginless printing; wherein a size of the print data determined by the determination means is smaller than that of the print data received by the receiving means.

As described above, this invention is characterized by determining the actual position of the print medium transported to the printing position; based on the determined print medium position, setting an area slightly larger than the print medium lying area as a print area; and performing the printing operation on that area. This makes it possible to keep the amount of ink ejected onto the overrunning area outside the print medium to a minimum required, reducing the running cost. Further, since the volume of ink ejected to the overrunning area outside the print medium can be minimized, the ink mist floating in the printing apparatus can also be reduced, alleviating the contamination due to the floating mist.

With this invention, positions of a few points at the ends of the print medium can be detected as the print medium is transported before reaching the scan area and, based on the detected positions, the print medium lying position in the scan area can be determined. Thus, an appropriate printing operation can be performed without reducing a throughput of the printing apparatus.

The above and other objects, effects and advantages of the present invention will become more apparent from the following description of embodiments thereof taken in conjunction with the accompanying drawings.

DETAILED DESCRIPTION OF PREFERRED EMBODIMENTS

Now, one embodiment of this invention will be described in the following paragraphs.

Figure 1:
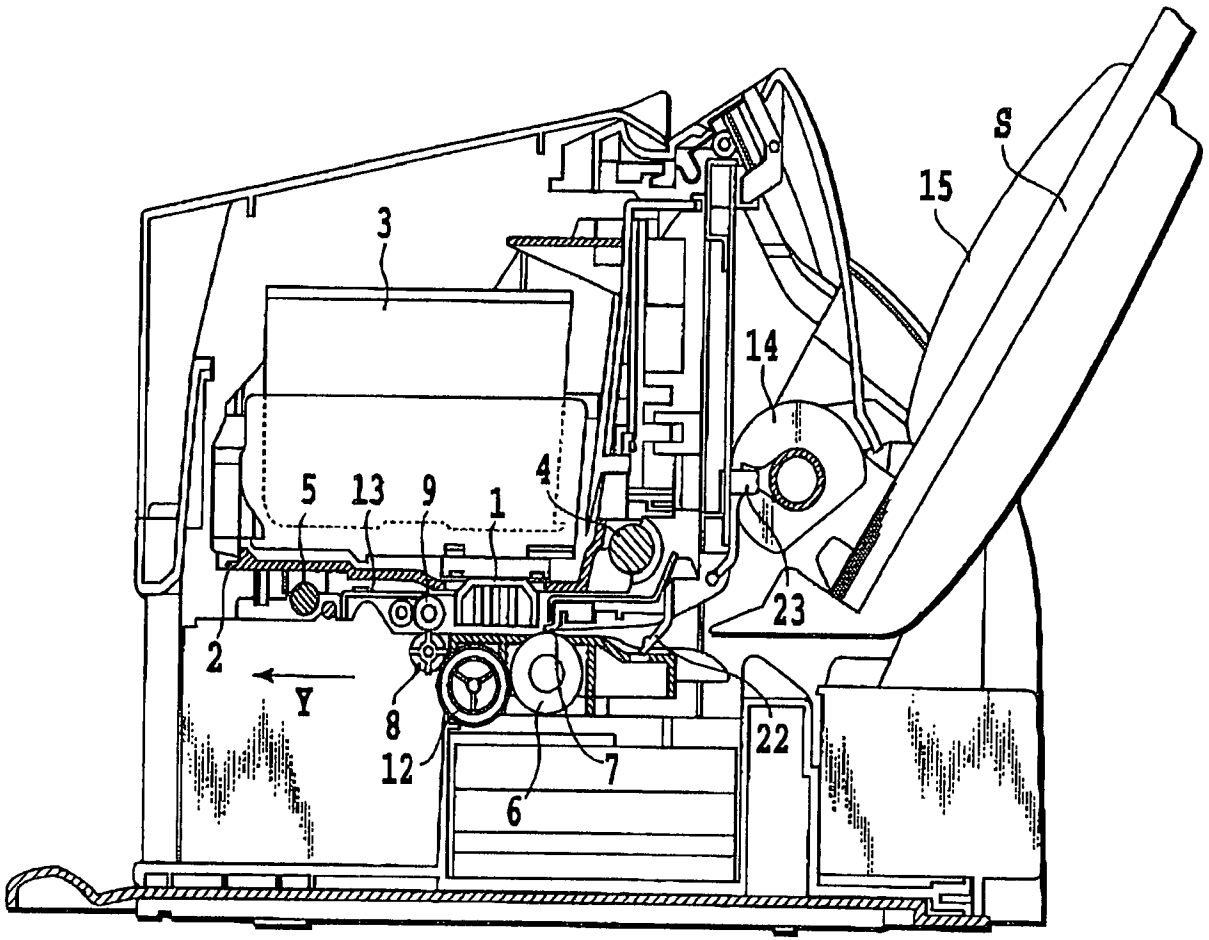
FIG. 1 is a vertical cross-sectional side view showing an overall construction of an ink jet printing apparatus in one embodiment of this invention.

FIG. 1 is a vertical cross-sectional side view showing an overall construction of an ink jet printing apparatus in one embodiment of this invention.

In the figure, reference number 1 denotes an ink jet print head (hereinafter referred to simply as a print head) as printing means to eject ink droplets onto a print medium for printing. The print head 1 has a plurality of ink ejection print elements or nozzles arranged at a predetermined pitch in a print medium transport direction (subscan direction (or Y direction)) so as to form dots at a predetermined resolution on the print medium.

Designated 2 is a carriage which carries the print head 1 scans in the main scan direction (a direction perpendicular to the plane of paper in FIG. 1). Reference number 3 represents an ink tank to supply ink to the print head 1 mounted on the carriage 2. Reference number 4 and 5 represent carriage shafts that guide the carriage 2 as it performs the main scan.

Denoted 6 is a first transport roller to feed the print medium in a print medium transport direction. The first transport roller 6 is arranged upstream, in the print medium transport direction, of an area (print position) where the print medium is printed by the print head 1. Reference number 7 is a first driven roller arranged to oppose the first transport roller 6. A second transport roller 8 to feed the print medium is arranged downstream, in the print medium transport direction, of the area (print position) where the print medium is printed by the print head 1. Denoted 9 is a second driven roller arranged to oppose the second transport roller 8. A transmission roller 12 is pressed by a spring (not shown) against the first transport roller 6 and the second transport roller 8 to convey a drive force of the first transport roller 6 to the second transport roller 8. A paper stacker 15 stacks sheets of print medium to be supplied for printing. The sheets of print medium stacked on the paper stacker 15 are transported by a supply roller 14 to the first transport roller 6. These rollers 6, 7, 8, 9, 12, 14 make up transport means to transport the print medium.

Designated 22 is a paper end detection lever 22 disposed at a predetermined paper end detection position in a transport path ranging from the supply roller 14 to the first transport roller 6. The paper end detection lever 22 rotates from an initial position to a predetermined position when it is contacted by the print medium S supplied from the paper stacker 15 and, after the rear end of the print medium has moved past the lever, returns to the initial position. Denoted 23 is a paper end sensor to detect when the paper end detection lever 22 rotates from the initial position to determine when the front or rear end of the print medium passes the paper end detection position. While in this embodiment, the paper end sensor 23 is constructed of an optical sensor that optically detects the rotation of the paper end detection lever 22, other sensors can also be employed. The paper end sensor 23 and the paper end detection lever 22 together constitute paper end detection means that detects when the end of the print medium supplied by the transport means passes the paper end detection position.

Figure 2:
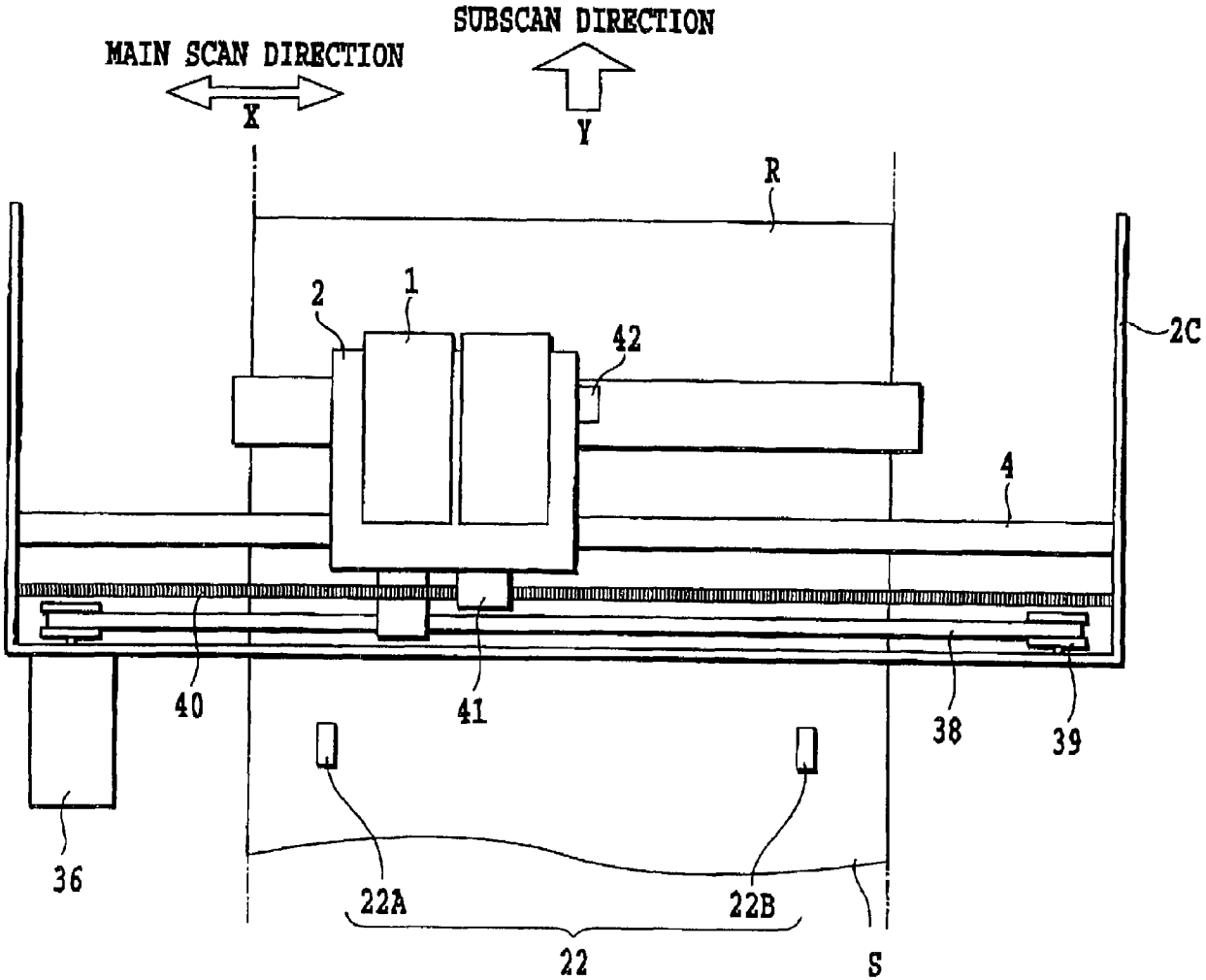
FIG. 2 is a plan view showing a scan unit and its peripheral construction for performing a main scan of a carriage 2 in the printing apparatus of FIG. 1.

FIG. 2 is a plan view showing a scan unit and its peripheral construction for performing the main scan of the carriage 2 in the printing apparatus of FIG. 1.

The print medium S stacked on the paper stacker 15 shown in FIG. 1 is fed by the supply roller 14 to the first transport roller 6, which then feeds the print medium intermittently in a subscan direction indicated by an arrow Y from the bottom side of FIG. 2 toward the top side. The carriage 2 with the print head 1 travels in the main scan direction (horizontal direction (X direction) of FIG. 2) perpendicular to the subscan direction (Y direction) in which the print medium is transported. As the carriage 2 travels, the print head 1 ejects ink droplets to form an image on the print medium S.

In FIG. 2, denoted 36 is a carriage motor to generate a drive force for reciprocating the carriage 2 in the main scan direction. A carriage belt 38 is an endless belt to transmit a drive force generated by the carriage motor 36 to the carriage 2. The carriage belt 38 is wound with a predetermined tension around a pulley 36*a* secured to a drive shaft of the carriage motor and a follower pulley 39. Designated 41 is an encoder (main scan position detection means) 41 fixed to the carriage. AB the carriage 2 travels, this encoder 41 reads a code on a code strip 40 running along the main scan direction and outputs a detection signal indicating the position of the carriage 2 in the main scan direction.

A paper width sensor (third detection means or paper width detection means) 42 secured to one side of the carriage 2 comprises a light emitting unit to emit light toward the transport path R of the print medium S as the carriage 2 travels and a light receiving unit to receive the light emitted from the light emitting unit and reflected by the print medium. This optical, reflection type sensor 42 detects the lateral side ends of the print medium in the main scan direction based on a change in output from the light receiving unit.

The paper end detection means described above are arranged at two locations a specified distance apart in the main scan direction. That is, in this embodiment, a first paper end detection lever 22A and a second paper end detection lever 22B are spaced a predetermined distance apart in the main scan direction as shown in FIG. 2. Though not shown in FIG. 2, there are provided first and second paper end sensors 23A, 23B (see FIG. 3) to detect the operation of the paper end detection levers 22A, 22B. As the front end of the print medium passes the first paper end detection lever 22A and the second paper end detection lever 22B, these levers are pushed by the front end of print medium and rotated from the initial position and, after the print medium has passed the levers, these levers return to their initial position. The rotated position of these levers is detected by the first and second paper end sensors. Thus, according to a change in output from the paper end sensors 23A, 23B it is possible to detect when the front and rear ends of the print medium pass the engagement positions with the levers (detection positions). The first paper end detection lever 22A and the first paper end sensor 23A constitute the first end detection means; and the second paper end detection lever 22B and the second paper end sensor 23B constitute the second end detection means.

Figure 3:
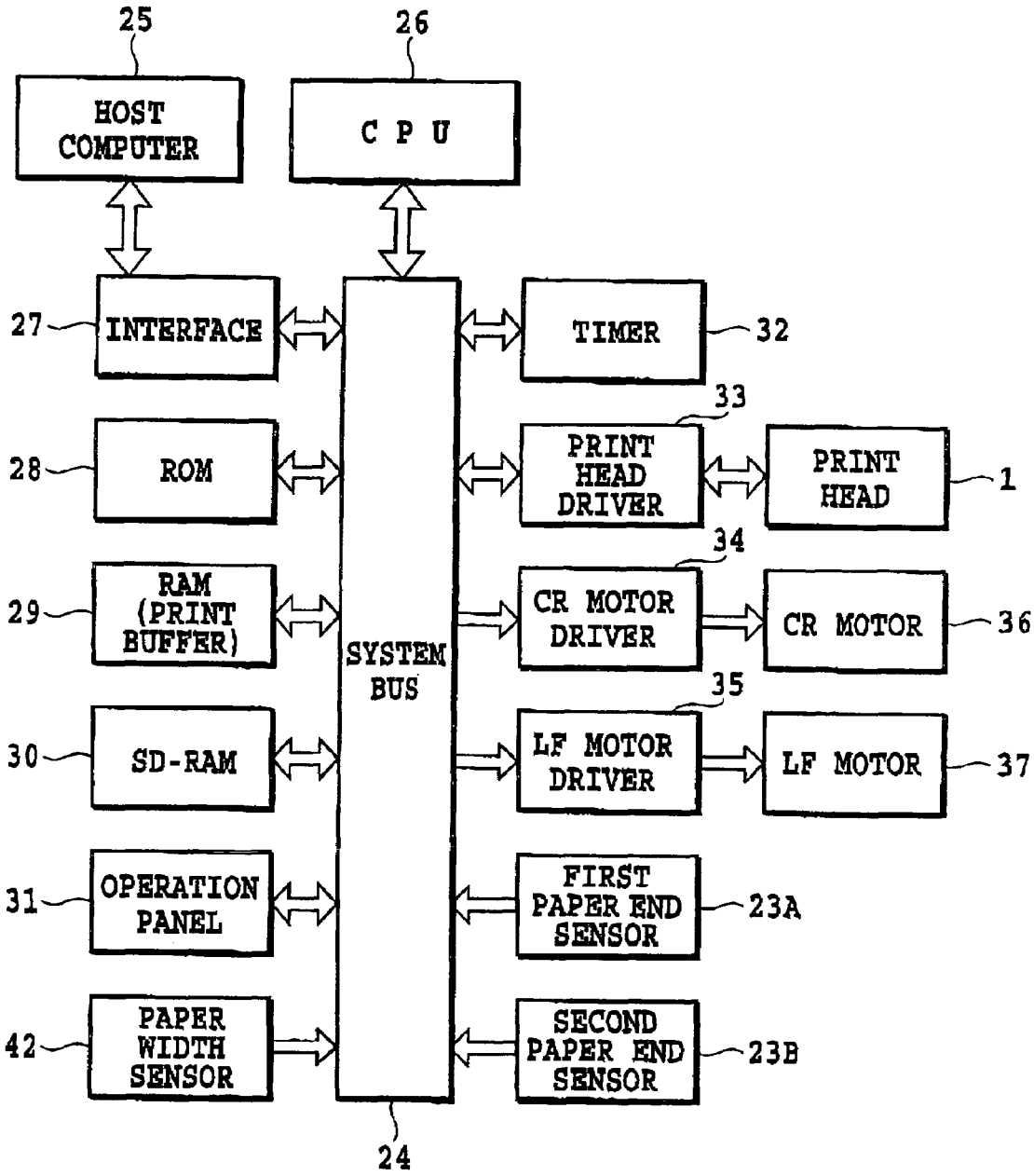
FIG. 3 is a block diagram showing an outline configuration of a control system for the printing apparatus in the embodiment of this invention.

FIG. 3 is a block diagram showing an outline configuration of a control system for the printing apparatus of this invention.

In the figure, denoted 26 is a CPU (control means) constructed of a microprocessor. The CPU 26 is connected through a system bus 24 and an interface 27 to a host computer 25. The CPU 26 controls the printing operation based on a program stored in ROM 28, print data supplied from a host computer and stored in a print buffer 29 of RAM, and output signals from the paper width sensor 42 and the first and second paper end sensors 23A, 23B. A SD-RAM 30 is a rewritable nonvolatile memory that can hold information even after power is cut off. An operation panel 31 accepts a variety of operations performed by the user.

Further, the CPU 26 controls a CR motor 36 and a LF motor 37 through motor drivers 34, 35 and also controls the print head 1 through a head driver 33 according to the print information stored in the RAM 29. The LF motor 37 may be a pulse motor or a DC motor with an encoder capable of counting a drive amount. Thus, the distance that the print medium is transported can be measured by the CPU 26 counting the drive amount of the LF motor. The position of the carriage can also be detected by the CPU 26 counting the drive amount of the CR motor. In this embodiment the drive force of the LF motor 37 is transmitted through a drive force transmission path (not shown) to the supply roller 14, first transport roller 6 and second transport roller 8.

Figure 4:
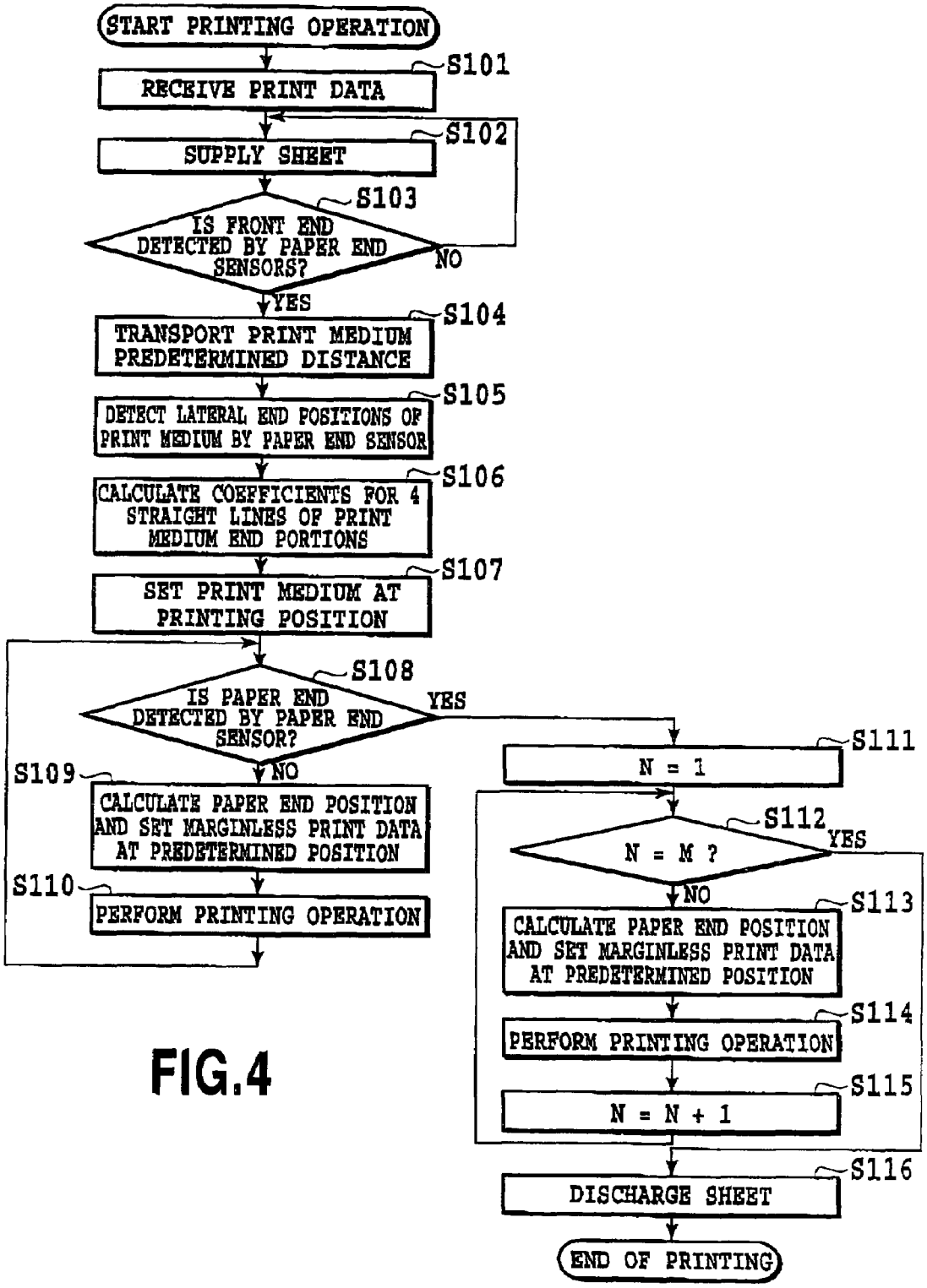
FIG. 4 is a flow chart showing an example of control sequence in the embodiment of this invention.
Figure 5:
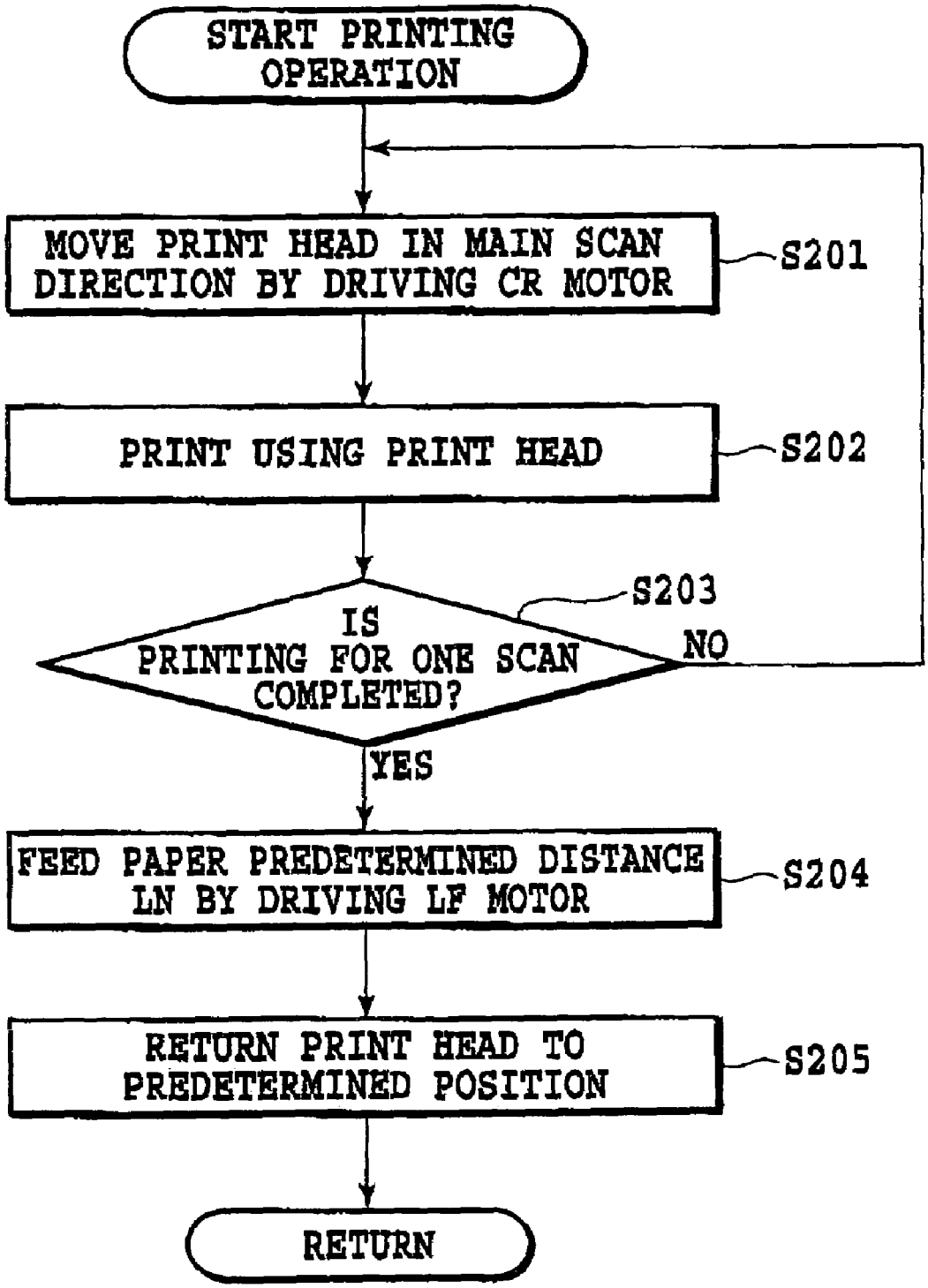
FIG. 5 is a flow chart showing another example of printing sequence in the embodiment of this invention.

A sequence of operations performed by the ink jet printing apparatus of the above construction during the marginless printing is shown in flow charts of FIG. 4 and FIG. 5. The marginless printing refers to forming an image without leaving a margin edge along the periphery of a print medium.

Upon receiving a print start command from the host computer 25, the program at the start of the printing operation stores the print data supplied from the host computer 25 in the receive buffer in the RAM 29 (S101). Here, in a work area in the RAM 29 the print data is converted into data which indicates whether individual print elements or nozzles of the ink Jet print head are to perform a printing action. The converted data is further mapped in a main scan buffer in the RAM 29 to indicate whether or not individual nozzles are to eject ink at each main scan position. The data for marginless printing generated by the host computer is larger in size than the print medium and corresponds to a combination of an entire area of the print medium and an area overrunning the edge of the print medium. A width of the overrunning area is determined by taking into account a maximum print medium transport error that may occur in the printing apparatus. Thus, should a transport error occurs with the print medium, the entire area of the print medium can be formed with an image.

In parallel with the execution of reception and conversion of the print data, print medium S stacked on the paper stacker 15 begins to be fed by the supply roller 14 in the subscan direction (Y direction) (S102). Then, the front end of the print medium S being fed engages the first paper end detection lever 22A and the second paper end detection lever 22B and rotates them. As a result, the output signals from the paper end sensors 23A, 23B corresponding to the paper end detection levers 22A, 22B change.

Figure 6:
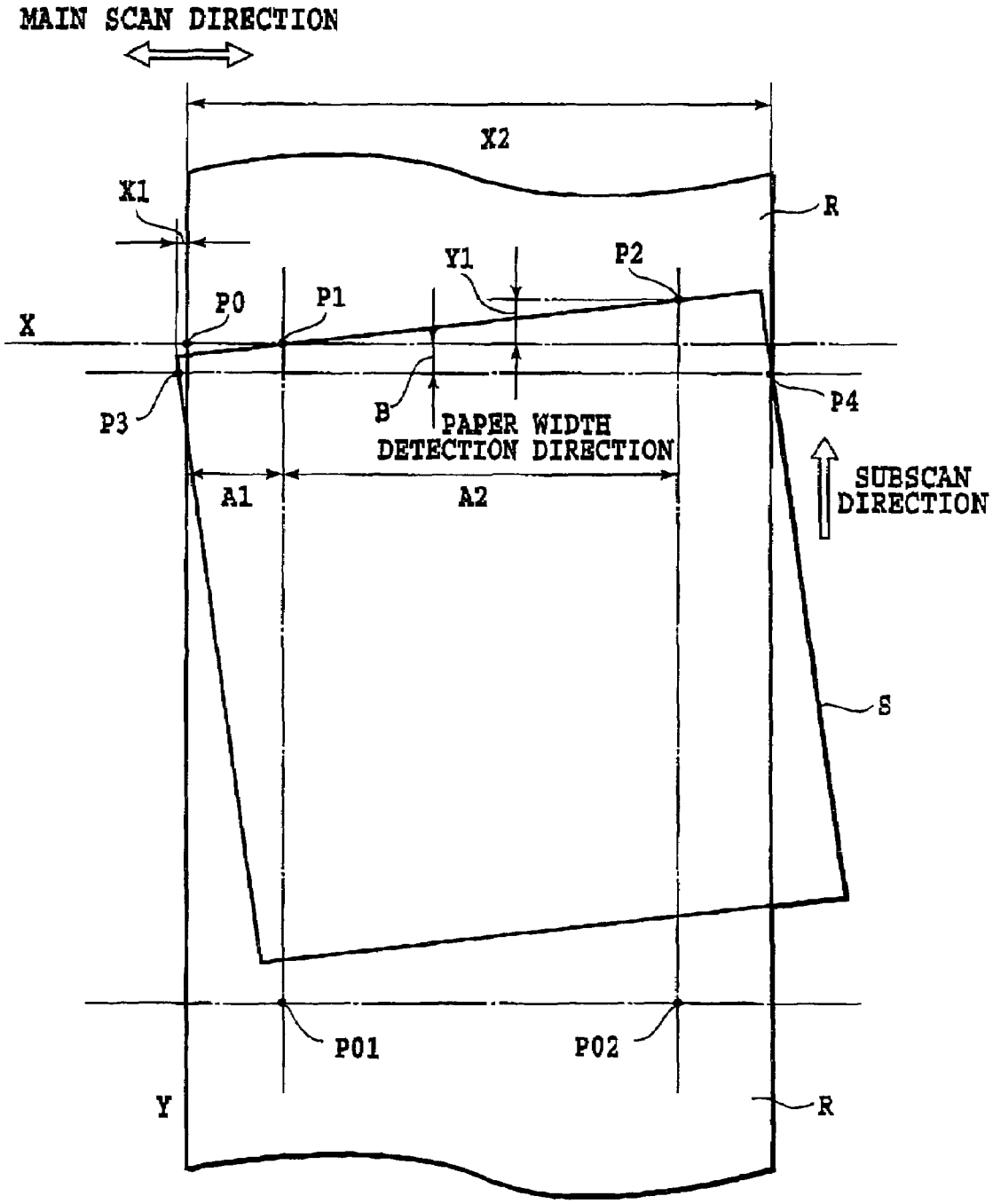
FIG. 6 is a schematic diagram showing how an end position of a print medium is determined in the embodiment of this invention.

Upon receiving the output signal status change, the CPU 26 decides that the front end of the print medium S has reached the paper end detection position. However, if the print medium S fed from the paper stacker 15 should be supplied slanted, as shown in FIG. 6, i.e., if the print medium S should be supplied so that its front end is not parallel to the main scan direction but at an angle to it, the front end of the print medium S reaches the first paper end sensor 23A and the second paper end sensor 23B at different timings. Thus, the status changes in the output signals from the paper end detection levers 22A, 22B occur at different timings. The CPU 26 converts the difference in the arrival time of the front end of the print medium (arrival time difference) between the paper end sensors 23A, 23B into a transport distance of the print medium S and stores the converted distance in a predetermined memory location. Then, the print medium S is fed a predetermined distance to a position where the front end of one side of the print medium S can be detected by the paper width sensor 42 mounted on the carriage 2 (S103 or S104).

With the front end of one side of the print medium S transported to a position where it can be detected by the paper width sensor 42, i.e., to a predetermined position in the main scan area of the print head 1, the carriage 2 is main-scanned to detect the lateral end positions of the print medium S (S105). Based on the feed distance in the transport operation of S104 and the lateral and positions detected by S105, position information can be obtained for a total of four points at the ends of the print medium S carried into the scan area, i.e., position information on two points at the front end of the print medium S and two points, one each at left and right side end. Further, by using the position information thus obtained and the medium size information on the print medium S transmitted from the host computer, the CPU 26 calculates the positions of the entire edge of the print medium S being transported (S106).

FIG. 6 shows one example method for edge position calculation.

In the figure, P01 denotes a reference position of the print medium set in the transport direction on a plane coordinates containing the transport path R of the print medium. The reference position corresponds to a position at which the first paper end sensor 23A detects the front or rear end of the print medium S through the first paper end detection lever 22A installed in the transport path R of the print medium S. The plane coordinates consists of an X axis virtually set in the main scan direction and a Y axis virtually set in the subscan direction.

P02 corresponds to a position where the second paper end sensor 23B detects the front or rear end of the print medium S through the second paper end detection lever 22B.

P0 denotes a corner position of the print medium S when it is transported the predetermined distance from the position of the first paper end sensor 23A in an appropriate condition with no slant in step S104 for the paper width sensor 42 to detect the lateral end positions of the print medium in the main scan direction. The corner position of the print medium S also serves as a reference position in the main scan direction on the plane coordinates and is a preset theoretical position.

P1 denotes a front end position in the subscan direction of the print medium S actually transported, the front end position being detected by the first paper end detection lever 22A.

P2 denotes a front end position in the subscan direction of the print medium S actually transported, the front end position being detected by the second paper and detection lever 22B.

P3 denotes the first of lateral end positions of the print medium S to be detected by the paper width sensor 42, i.e., the position of the paper width sensor 42 when the level of the output signal from the paper width sensor 42 goes high.

P4 denotes the last of lateral end positions of the print medium S to be detected by the paper width sensor 42, i.e., the position of the paper width sensor 42 when the level of the output signal from the paper width sensor 42 goes low.

Further, let A1 stand f or a distance in the main scan direction from the corner position P0 of the print medium S to the paper end detection position of the first paper end sensor 23A; A2 for a distance in the main scan direction from the paper end detection position of the first paper end sensor 23A to the paper end detection position of the second paper end sensor 23B; and B for a distance in the subscan direction from the paper width sensor 42 to P0.

When the front end of the print medium S being actually transported is detected, the position in the subscan direction of the front end of the print medium S as detected by the second paper end sensor 23B is taken to be Y1. This detected position Y1 can be determined from the difference between the timings at which the paper end sensors 23A, 23B detect the front end of the print medium S in the subscan direction as it is supplied and transported in step S103, from the distance that the print medium is transported by the LF motor 37 during that timing difference, and from the distance in the subscan direction between the detection position of the first paper end sensor 23A and the detection position of the second paper end sensor 23B. If the paper end detection positions of the first and second paper end sensors 23A, 23B differ in the subscan direction, the difference between the two detection positions needs to be determined. However, in this embodiment since these sensors 23A, 23B have the same detection positions in the subscan direction, there is no need to determine the difference.

In the paper end detection operation executed in step S105, let the position in the main scan direction of the first end of the print medium to be detected by the paper width sensor 42 (position to the left of the print medium) be X1. Further, in the same paper end detection operation, let the position in the main scan direction of the last end of the print medium to be detected by the paper width sensor 42 (position to the right of the print medium) be X2.

From the values shown above, the x-y coordinates of P0. P1, P2, P3 and P4 are given as follows.

P0=(0, 0)

P1=(A1, 0)

P2=(A1+A2, Y1)

P3=(X1, B)

P4=(X3, B)

From the positions of the above points, the front end, rear end, left side end and right side end of the print medium being actually transported are represented by the following straight lines on the x-y coordinates with P0 and P01 as reference points.

That is, the front end of the print medium in the subscan direction is given by $$y=(Y1/A2)x-(Y1/A2)A1 \quad (1)$$

The end point of the print medium which the paper end sensor first passes in the main scan direction is given by $$y=(-A2/Y1)x+B+(A2\cdot X1/Y1) \quad (2)$$

The end point of the print medium which the paper end sensor last passes in the main scan direction is given by $$y=(-A2/Y1)x+B+(A2\cdot X2/Y1) \quad (3)$$

The rear end of the print medium in the subscan direction is given by $$Y=(Y1/A2)x-(Y1/A2)A1-L0 \quad (4)$$

Here, L0 is a theoretical length of the print medium in the subscan direction.

The position of the rear end of the print medium in the transport direction may be calculated based on information about the rear end of the print medium as detected by the first paper end detection lever 22A and the second paper end detection lever 22B during the process of printing.

When the print medium is transported, the positions of the front and rear ends of the print medium in the subscan direction can be expressed with the position P0 taken as the origin, as described above. The positions of the lateral ends in the main scan direction can be calculated from the above equation representing the position in the subscan direction y from P0.

As described above, the feed distance of the print medium is managed by the drive amount of the LF motor 37 and the theoretical front end position P0 of the print medium being printed can be determined by the construction of the apparatus, i.e., the positions of the first and second detection levers, 22A, 22B and the first and second paper end sensors 23A, 23B. The position of the print area to be printed by the print head 1 can also be determined with the position P0 as a reference. Further, the positions of the end points in the print area of the print medium being transported can be determined on the x-y coordinates by the above calculation by taking P0 as origin.

Then, the print medium is set at a position where the marginless printing can be started from the front end of the print medium using the print head 1 (S107). Here, the print medium S that was transported to a position where it can be detected by the paper width sensor 42 (indicated by a solid line in FIG. 6) is further fed forward in the subscan direction.

Figure 7:
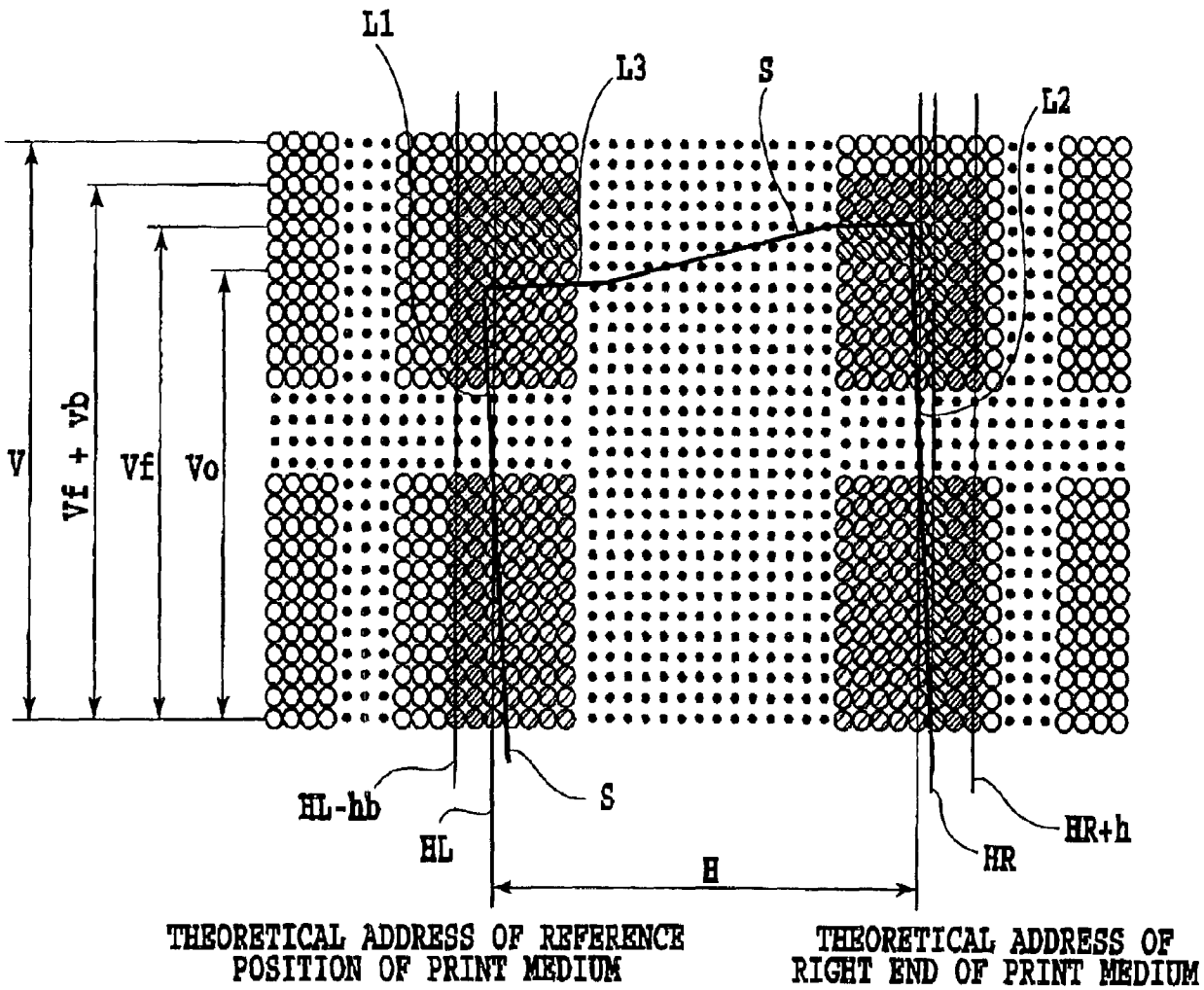
FIG. 7 is a schematic diagram showing how print data is set for a front end portion of the print medium in the embodiment of this invention.

Next, a check is made as to whether the rear end of the print medium 19 detected by the paper end sensors 23A and 23B. If the rear end of the print medium is not yet detected, the program moves to S109. Here, based on equation 1 to equation 4, the paper end data is calculated to generate print data for marginless printing, which is then mapped in the main scan buffer in the RAM 29. In S109, from among the marginless print data sent from the host computer, i.e., the marginless print data which is already set with an overrunning width considering the maximum transport error, data at those addresses corresponding to the area where the print medium exists and to the overrunning area is determined, as shown in FIG. 7. Then, the identified data is mapped in the main scan buffer provided in the RAM 29. This makes the overrunning area narrower than that of the print data generated by the host computer.

Here, how the print data is mapped in the main scan buffer in the RAM 29 will be explained by referring to FIG. 7.

In the figure, BF represents the main scan buffer. In the main scan buffer BF, the vertical direction of the drawing, when viewed from the front, matches the subscan direction (print medium transport direction) in which a plurality of nozzles of the print head 1 are aligned, and the top side of the drawing corresponds to the downstream side of the transport direction. An address assignment to the buffer elements in the subscan direction is made such that the elements on the bottom side of the drawing have lower-order addresses and those on the top side higher-order addresses. The number of addresses allocated in the subscan direction is set equal to the number of nozzles of the print head. Here, addresses 0-V are set.

Further, the elements of main scan buffer BF are so arranged that the lateral or horizontal direction of the drawing, when viewed from the front, matches the main scan direction and that the buffer element pitch in the main scan direction matches the pitch of dots formed by ink droplets ejected from the print head 1 during the main scan. The address assignment in the main scan direction is such that the elements on the left side have lower-order addresses and those on the right side have higher-order addresses.

In this main scan buffer BF, the print data setting in the subscan direction is made as follows.

At the start of the marginless printing, the front end of the print medium lies in an area where it can be printed by the print head 1 (print area).

A theoretical front end position of the print medium S, which is determined from the construction of the printing apparatus and the managed paper supply and transport distance, lies at a position V0 in the main scan buffer BF (V0≦V). V0 is calculated from the positions in the subscan direction of the first and second paper end sensors 22A, 22B, the transport distance of the print medium S to the subscan direction position of the print head, and the arrangement pitch of nozzles of the print head 1. At this time, the positions of the front end of the print medium scanning the full width in the main scan direction are determined from equation 1. Then, of the positions determined here one located most downstream in the subscan direction (the position of the most forward end in the transport direction) is chosen and a subscan direction address in the main scan buffer for that selected location is determined.

FIG. 7 shows an example case of how print data is set in the main scan buffer BF when the print medium S is transported, tilted as shown in FIG. 6, to the printing position where it is printed by the print head 1. Of the positions of the front end of the print medium, the one detected by the first paper end detection lever 22A lies at an address V0 in the subscan direction after the print medium S has been transported to the predetermined position in S107. Further, of the front end of the print medium, the left end portion in the figure lies most upstream in the transport direction (upstream of V0) and the right end portion lies most downstream in the transport direction (downstream of V0). Thus, a dot at an address Vf corresponding to the right end of the print medium S is set as a dot formation position in the subscan direction for the front end of the print medium S.

Further, as an overrunning area for the marginless printing, a dot formation area vb dots wide is added to the address Vf. As described above, since the position of the front end of the print medium is precisely determined by calculation, the overrunning area vb dots wide can be set to a minimum required to ensure that ink dots can cover the sides of the front end portion.

To start the marginless printing properly from the front end of the print medium S, the transport distance that the first print medium S must be transported to be set inside the print area E where it is printed by the print head 1, i.e., the transport distance the print medium S is fed in S107, need only be determined so as to meet the following condition:

$$V0 \leqq Vf < Vf + vb \leqq V$$

In this transport operation, since the positional difference between the left and right sides of the front end of the print medium is already calculated, the transport distance that meets the above requirement can be chosen reliably based on the positional difference.

Next, how the lateral end positions of the print medium in the main scan direction are set will be explained.

As described above, the theoretical front end of the print medium S, which is preset in the planar coordinates, lies at a position corresponding to an address V0 in the subscan direction. Hence, the main scan direction positions of the left side end and right side end of the print medium S situated in a range of V0 can be calculated based on the position P0 in FIG. 6.

After the main scan direction positions of the left end portion of the print medium S are calculated for the V0 range, these positions are converted into addresses in the main scan buffer. This conversion is done by using an ink ejection pitch (pitch of dots formed) in the main scan. Of the addresses in the main scan buffer corresponding to the main scan direction positions of the left end portion in the V0 range, a most outward address (lowest-order address on the x axis) is chosen and set as a leftmost end address.

In FIG. 7, the leftmost end address in the main scan direction of the print medium S calculated by equation 2 agrees with all of the left end addresses HL of the print medium S in the range V0. Therefore, the main scan direction address HL in the main scan buffer is taken as an address of the left side end. To this left side end address HL (corresponding to the left end portion) the overrunning area hb for the marginless printing is added. The hb can also be set to a minimum required width as in the case of vb.

The right end portion can also be set in the same way as in the left end portion. In FIG. 7 the outermost of the right side ends calculated by equation 1 lies on the outside of the theoretical right end portion of the print medium S. Therefore, the calculated value HR for the outermost end is used as the right side end of the reference print area. Then, the overrunning area hb is set for the right side end of the reference print area.

Figure 8:
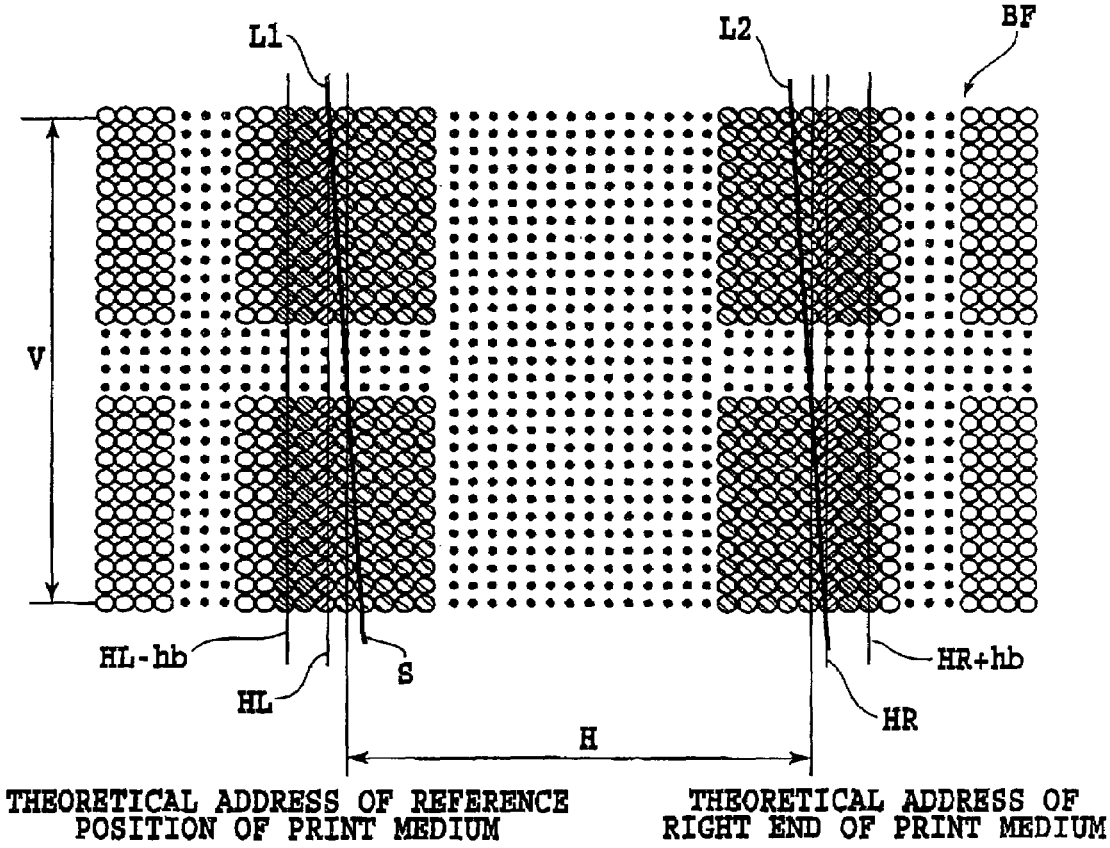
FIG. 8 is a schematic diagram showing how print data is set for a side end portion of the print medium in the embodiment of this invention.

Next, by referring to FIG. 8, how the print data is set will be explained for a case where, after the front end of the print medium S has passed the print area in the printing apparatus, the printing operation is performed by using all the printing elements or nozzles of the print head 1, i.e., when ends of the print medium exist only in the main scan direction.

The distance from the theoretical front end position of the print medium S to the print area printed by the print head 1 can be calculated from the managed transport distance of the print medium S. Further, the main scan direction positions of the lateral ends of the print medium S can be calculated by equation 2 and equation 3. Therefore, the print data can be set in the main scan buffer BF in the same way as described above with reference to FIG. 7.

That is, as to the left end portion of the print medium S, after the positions of the left end portion of the print medium S are determined for the range V by using the transport distance of the print medium S and equation 2, these positions are converted into addresses in the main scan buffer. This conversion is done by using the ink ejection pitch of the print head 1 in the main scan direction. Then, of the converted addresses for the left end portion of the print medium in the range V, a lowest-order address, i.e., an address for the print medium position located outermost in the main scan direction in the range V, is selected. This selected address is indicated by a line HL in FIG. 8. Then, for this address, the overrunning area hb used for the marginless printing is set. The address for the overrunning area is (HR−hb).

For the right end portion, too, the same setting method that was used for the left end portion can be applied. In FIG. 8 an address corresponding to the outermost position of the print medium is indicated by a line HR. Then, for this address, the overrunning area hb is set. Its address is (HR+hb).

Since the rear end of the print medium S can be expressed by equation 4, the print data for the rear end can also be set in a manner similar to that applied to the front end portion which was described with reference to FIG. 7.

Figure 9:
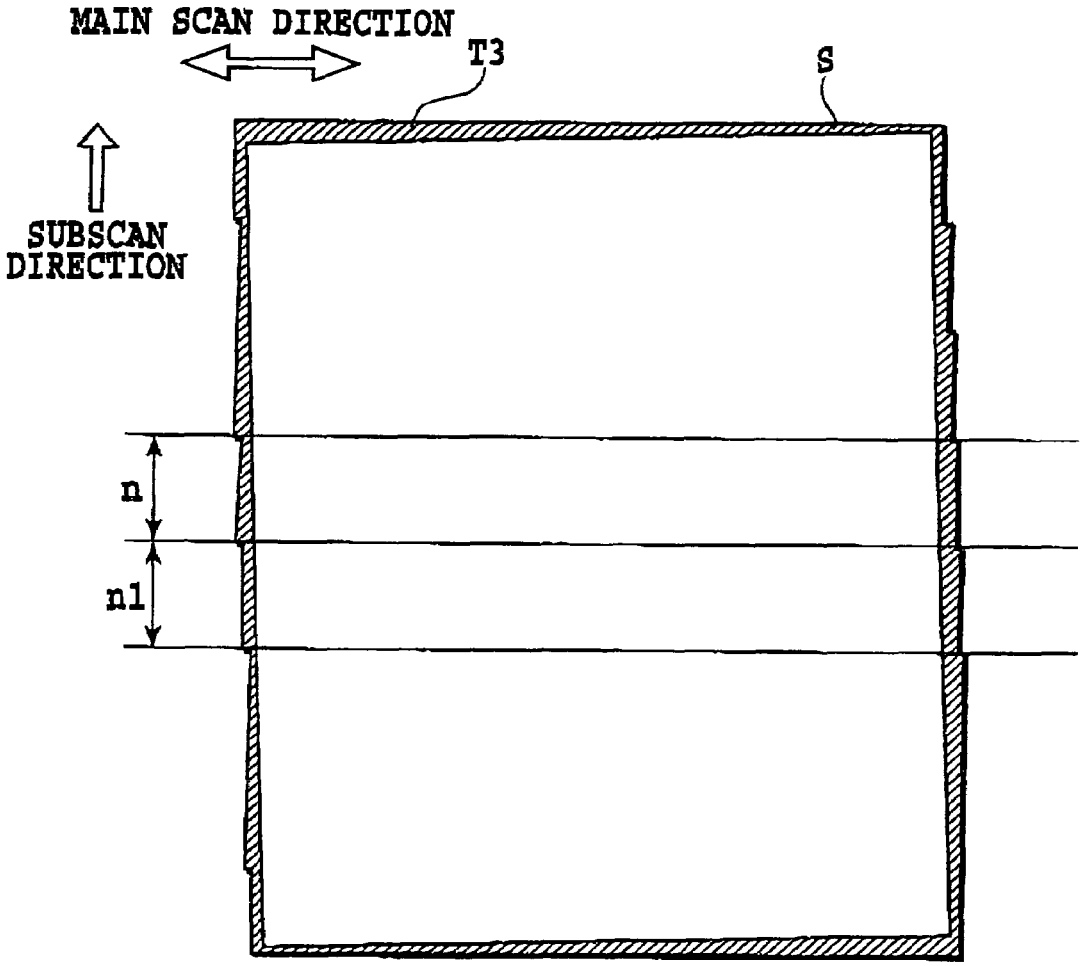
FIG. 9 is a schematic diagram showing how an ink ejection area is set in the embodiment of this invention.
Figure 10:
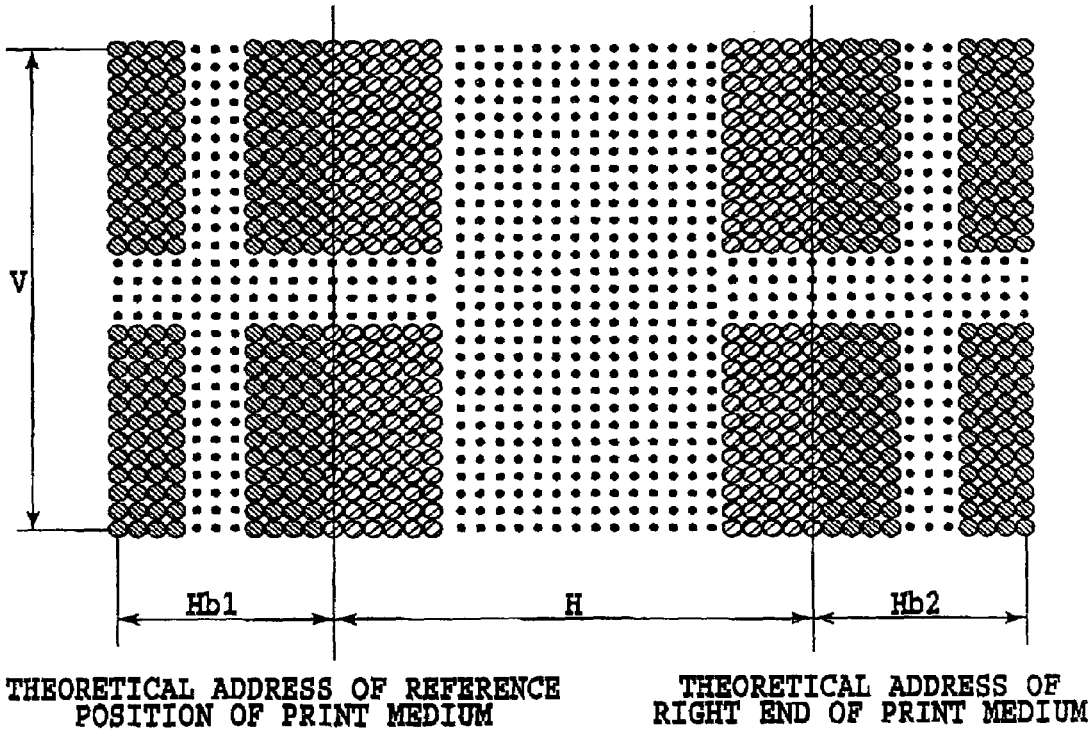
FIG. 10 is a schematic diagram showing how print data is set in a conventional ink jet printing apparatus.
Figure 11:
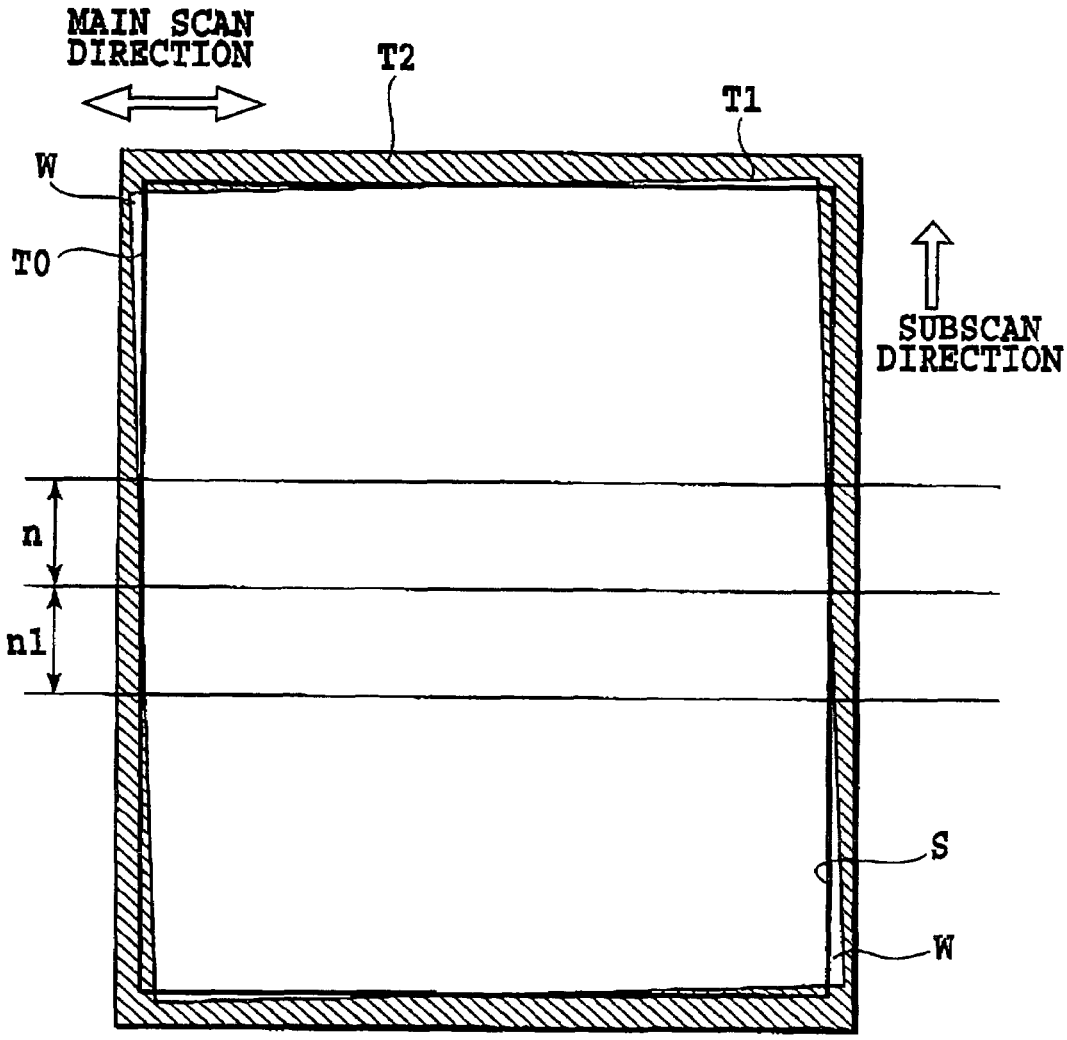
FIG. 11 is a schematic diagram showing an example of ink ejection area in the conventional printing apparatus.

The method of setting an overrunning area for marginless printing in one embodiment of this invention has been described. An overrunning area T3 set for the entire print medium S by this setting method is shown in FIG. 9. The area T3 in FIG. 9 is apparently narrower than an area T2 set by the conventional method (see FIG. 11), and performing the printing operation on this narrow area can reliably result in a marginless printing. This printing method can reduce ink consumption, leading to reductions in the running cost and the ink mist volume generated, which in turn alleviates contamination of the interior of the printing apparatus. In FIG. 9, n represents an area printed by an nth main scan and n1 represents an area printed by a (n+1)th main scan.

Then the print data is set in the main scan buffer BF for each main scan (S109) and the printing operation is performed to print according to the set print data (S110).

The printing operation will be described by referring to the flow chart of FIG. 5.

First, the carriage motor 36 is activated to start the main scan of the carriage 2 (S201). Next, according to the print data set in the main scan buffer BF, ink is ejected from the nozzles of the print head 1 onto the print medium S to form an image (S202). After the printing based on all the print data set in the main scan buffer BF for one main scan has been completed (S203), the print medium S is transported in the subscan direction for the next main scan area on the print medium to be printed. This is done by driving the LF motor 37 to rotate the transport rollers 6, 8 to feed the print medium a predetermined distance equal to the width of the print head 1 as measured in the subscan direction (S204). Then, the carriage 2 is returned to the initial position (S205). With the above sequence of steps S201-205, the printing operation for one main scan is completed.

Returning again to FIG. 4, when, after the printing operation of steps S201-S205 is repetitively executed, the rear end portion of the print medium S is detected by the paper end sensors 23A, 23B (S108 of FIG. 4), the calculation of paper end positions and the setting of marginless print data in the main scan buffer BF are performed in step S113 and S114 in the same way as in step S109 and S110 described above. This operation is repetitively executed until the number of operations N in step S114 and S115 reaches a preset value of M, at which time the printing operation on the rear end portion of the print medium is finished. Then, the print medium is discharged to a predetermined discharge position by the second transport roller 8 (S116).

As described above, in this embodiment, two portions at the front end of the print medium S can be detected during its transport operation before the print medium reaches the scan area and, based on the detected front end positions, information about where the print medium lies in the scan area can be obtained. Thus, an appropriate printing operation as described above can be performed efficiently without degrading throughput of the printing apparatus.

Other Embodiments

In addition to the first paper end sensor 23A and the second paper end sensor 23B to detect the ends (front and rear ends) of the print medium in the subscan direction, the above embodiment uses the paper width sensor 42 incorporating an optical reflection sensor to detect the positions of the lateral ends of the print medium in the main scan direction. Then the positions of the ends of the print medium are calculated from the position data, detected by the above sensors, of a total of four locations, two at the front end and two at side ends of the print medium, and also from the paper size information on the print data sent from the host computer. This invention is not limited to this configuration. For example, the positions of two corners at the front and of the print medium may be detected by using a line sensor or area sensor of CCD as the paper width sensor 42. Then, the positions of the ends of the print medium can be calculated by using the above detected information, the transport distance from the front end of the print medium as measured by the first paper end sensor 23A, and the paper size information on the print data sent from the host computer.

Further, in the above embodiment the two paper end detection levers 22A and 22B are located at the same positions in the subscan direction, i.e., they are arranged on the same straight line parallel to the main scan direction of the print head 1. However, the two paper end detection levers 22A, 22B may be located at different positions in the subscan direction. That is, the two paper end detection levers may be arranged on a line crossing the main scan direction. This invention is not limited to the above embodiment.

Further, while in the above embodiment the reference position in the transport direction in a plane coordinates is represented by P01 and the reference position in the main scan direction by P0, it is possible to set the reference positions in the scan direction and in the transport direction at one point P01 or P0, or to use one or two points other than these as the reference positions.

The present invention has been described in detail with respect to preferred embodiments, and it will now be apparent from the foregoing to those skilled in the art that changes and modifications may be made without t departing from the invention in its broader aspect, and it is the intention, therefore, in the apparent claims to cover all such changes.

The application claims priority from Japanese Patent Application No. 2004-235581 filed Aug. 12, 2004, which is hereby incorporated by reference herein.

What is claimed is:

1. A printing apparatus for performing a printing operation without leaving a margin at an end of a print medium by ejecting ink from printing means; comprising:

a receiving unit configured to receive first print data of a larger size than that of the print medium;

a transport unit configured to transport the print medium in a transport direction;

a front end detection unit configured to detect a front end of the print medium, the front end detection unit being located upstream of the printing means in the transport direction;

a lateral end detection unit configured to detect a lateral end of the print medium, the lateral end detection unit being movable in a direction crossing the transport direction;

a generating unit configured to generate second print data of a smaller size than that of the first print data by selecting a part of the first print data received by the receiving unit based on a detection result of the front end of detection unit and a detection result of the lateral end detection unit; and a driving unit configured to drive the printing means to execute the printing operation based on the second print data generated by the generating unit.

2. The printing apparatus according to claim 1, wherein the front end detection unit includes a lever that moves when the print medium contacts the lever and a sensor that detects the movement of the lever.

3. The printing apparatus according to claim 1, wherein the front end detection unit includes a first detection device and a second detection device located at a position different from the position at which the first detection unit is located in a direction crossing the transport direction;

wherein the detection result of the front end detection unit includes results of the first detection unit and the second detection unit.

4. The printing apparatus according to claim 1, wherein the lateral end detection unit includes the optical reflection sensor having a light emitting unit and a light receiving unit.

5. The printing apparatus according to claim 1, further comprising a carriage configured to mount the printing means, wherein the lateral end detection unit is provided to the carriage, and wherein an operation for detecting the lateral end by the lateral end detection unit is performed in a movement of the carriage in the direction crossing the transport direction.

6. A method of performing a printing operation without leaving a margin at an end of a print medium by ejecting ink from a print head, the method comprising the steps of:

receiving first print data of a larger size than that of the print medium;

transporting the print medium in a transport direction;

detecting a front end of the print medium at a position located upstream of the print head in the transport direction;

detecting a lateral end of the print medium direction crossing the transport direction;

determining a position of the print medium based on the detected front end of the print medium and the detected lateral end of the print medium;

generating second print data for an area on the print medium by selecting a part of the first print data received by the receiving step based on a determining result from the determining step; and performing the printing operation based on the second print data generated by the generating step.

7. A printing apparatus for executing a marginless printing that performs a printing operation without leaving a margin at an end of a print medium by ejecting ink from a print head, the printing apparatus comprising:

a receiving unit configured to receive first print data of a larger size than that of the print medium;

a transport unit configured to transport the print medium in a transport direction;

a front end detection unit configured to detect a front end of the print medium, the front end detection unit being located upstream of the print head in the transport direction;

a carriage configured to mount the print head;

a lateral end detection unit configured to detect a lateral end of the print medium, the lateral end detection unit being provided with the carriage;

a scanning unit capable of scanning the carriage in a scan direction crossing the transport direction so as to detect the lateral end of the print medium by the lateral end detection unit;

a determining unit configured to determine a position of the print medium transported by the transport unit based on a detection result of the front end detection unit and a detection result of the lateral end detection unit;

a generation unit configured to generate second print data of a smaller size than that of the first print data by selecting a part of the first print data received by the receiving unit based on a determining result of the determining unit; and a driving unit configured to drive the printing head to execute the marginless printing based on the second print data generated by the generation unit.

* * * * *